US012070132B2

(12) United States Patent
McGraw

(10) Patent No.: US 12,070,132 B2
(45) Date of Patent: Aug. 27, 2024

(54) SEATING STRUCTURE HAVING A KNITTED SUSPENSION MATERIAL

(71) Applicant: MILLERKNOLL, INC., Zeeland, MI (US)

(72) Inventor: Ethan McGraw, Holland, MI (US)

(73) Assignee: MILLERKNOLL, INC., Zeeland, MI (US)

( * ) Notice: Subject to any disclaimer, the term of this patent is extended or adjusted under 35 U.S.C. 154(b) by 0 days.

(21) Appl. No.: 18/463,140

(22) Filed: Sep. 7, 2023

(65) Prior Publication Data

US 2024/0081537 A1 Mar. 14, 2024

Related U.S. Application Data

(60) Provisional application No. 63/405,088, filed on Sep. 9, 2022.

(51) Int. Cl.
*A47C 5/02* (2006.01)
*A47C 7/28* (2006.01)
(Continued)

(52) U.S. Cl.
CPC ..... *A47C 5/02* (2013.01); *D04B 1/102* (2013.01); *D04B 1/123* (2013.01); *D04B 1/22* (2013.01); *D10B 2503/00* (2013.01)

(58) Field of Classification Search
USPC ..... 297/451.9
See application file for complete search history.

(56) References Cited

U.S. PATENT DOCUMENTS 3,115,693 A * 12/1963 Chandler ..... D04B 1/123 28/167
4,239,720 A 12/1980 Gerlach et al.
(Continued)

FOREIGN PATENT DOCUMENTS

CN 109989166 A 7/2019
EP 0867548 A2 9/1998
(Continued)

OTHER PUBLICATIONS

PCT Search Report and Written Opinion for PCT/US2023/032205, dated Dec. 8, 2023 (14 pages).
(Continued)

*Primary Examiner* — Robert Canfield
(74) *Attorney, Agent, or Firm* — Michael Best & Freidrich LLP

(57) ABSTRACT

An article of furniture includes a frame defining an opening, and a suspension material spanning over the opening and having a weft knit construction. The suspension material is configured to support a user, and the suspension material includes at least one multifilament forming a jersey knit structure which has a plurality of courses extending in a course direction and a plurality of wales extending in a wale direction, and at least one monofilament corresponding to and being inlaid in a respective one of the courses. The suspension material has, in the course direction, a ratio of machine gauge, in needles per mm, to course stiffness, in N per mm, between 0.02 and 0.2 and has, in the wale direction, a ratio of machine gauge, in needles per mm, to wale stiffness, in N per mm, between 0.07 and 1.4.

20 Claims, 5 Drawing Sheets

(51) Int. Cl.

| | |
|---|---|
| ***D04B 1/10*** | (2006.01) |
| ***D04B 1/12*** | (2006.01) |
| ***D04B 1/22*** | (2006.01) |

(56) References Cited

U.S. PATENT DOCUMENTS 4,469,739 A 9/1984 Gretzinger et al.
4,660,888 A 4/1987 Urai
5,013,089 A 5/1991 Abu-Isa et al.
5,027,618 A * 7/1991 Robinson ..... D04B 1/22 66/195
5,209,084 A * 5/1993 Robinson ..... D04B 1/102 66/196
5,230,370 A 7/1993 Gysin
5,255,538 A 10/1993 Day et al.
5,379,615 A 1/1995 Shima
5,393,596 A 2/1995 Tornero et al.
5,596,888 A 1/1997 McLarty, III et al.
5,692,399 A 12/1997 Takahashi et al.
6,205,822 B1 3/2001 Roell
6,276,178 B1 8/2001 West et al.
6,302,487 B1 10/2001 Fujita et al.
6,644,070 B2 11/2003 Ikenaga et al.
6,758,068 B2 7/2004 Shirasaki et al.
6,912,877 B2 7/2005 Yokoyama et al.
7,240,522 B2 7/2007 Kondou et al.
7,552,604 B1 6/2009 Waldrop et al.
7,611,997 B2 11/2009 Wigent, III
7,631,933 B2 12/2009 Fujita et al.
7,682,994 B2 3/2010 Van Emden et al.
7,696,110 B2 4/2010 Taniguchi et al.
7,731,294 B2 6/2010 Yasuda et al.
7,851,390 B2 12/2010 Salzmann et al.
8,104,832 B2 1/2012 Fujita et al.
8,419,135 B2 4/2013 Moeseneder et al.
8,434,331 B2 5/2013 Funaki et al.
8,522,577 B2 9/2013 Huffa
8,572,786 B2 11/2013 Davis et al.
8,590,345 B2 11/2013 Sokolowski et al.
8,959,800 B2 2/2015 Sokolowski et al.
8,959,959 B1 2/2015 Podhajny
9,010,157 B1 4/2015 Podhajny
9,032,763 B2 5/2015 Meir et al.
9,055,818 B2 6/2015 Ludeke et al.
9,072,335 B1 7/2015 Podhajny
9,095,187 B2 8/2015 Baudouin et al.
9,145,629 B2 9/2015 Podhajny
9,226,540 B2 1/2016 Podhajny
9,301,567 B2 4/2016 Dealey et al.
9,301,615 B2 4/2016 Behar et al.
9,371,603 B2 6/2016 Meir
9,375,045 B2 6/2016 Farris et al.
9,375,046 B2 6/2016 Meir
9,392,835 B2 7/2016 Dekovic et al.
9,404,206 B2 8/2016 Meir
9,445,649 B2 9/2016 Huffa et al.
9,510,637 B2 12/2016 Podhajny et al.
9,516,921 B2 12/2016 Millette et al.
9,526,293 B2 12/2016 Bell et al.
9,681,694 B2 6/2017 Ng et al.
9,681,704 B2 6/2017 Podhajny et al.
9,695,529 B2 7/2017 Ng et al.
9,723,890 B2 8/2017 Long et al.
9,730,484 B2 8/2017 Dua et al.
9,745,677 B2 8/2017 Dua et al.
9,775,401 B2 10/2017 Cross et al.
9,848,673 B2 12/2017 Cross
9,856,587 B2 1/2018 Akita
9,877,536 B2 1/2018 Huffman et al.
9,890,485 B2 2/2018 Podhajny
9,903,054 B2 2/2018 Cross et al.
9,907,349 B2 3/2018 Huffman et al.
9,918,511 B2 3/2018 Dua et al.
9,924,761 B2 3/2018 Huffa et al.
9,968,156 B2 5/2018 Huffman et al.
9,987,949 B2 * 6/2018 Lilley ..... B60N 2/002
10,092,058 B2 10/2018 Droege et al.
10,143,260 B2 12/2018 Mallen et al.
10,145,044 B2 12/2018 Schenk et al.
10,172,422 B2 1/2019 Podhajny et al.
10,182,619 B2 1/2019 Mallen et al.
10,182,657 B2 1/2019 Beyer et al.
10,194,711 B2 2/2019 Dua et al.
10,194,714 B2 2/2019 Mcginnity et al.
10,231,503 B2 3/2019 Greene et al.
10,294,591 B2 5/2019 Podhajny et al.
10,294,592 B2 5/2019 Uesato
10,299,544 B2 5/2019 Bruce et al.
10,315,535 B2 6/2019 Asai et al.
10,364,517 B2 7/2019 Dua et al.
10,378,130 B2 8/2019 Dua et al.
10,383,388 B2 8/2019 Podhajny
10,398,196 B2 9/2019 Minami et al.
10,406,404 B2 9/2019 Bichler et al.
10,455,885 B2 10/2019 Tamm
10,471,870 B2 11/2019 Mankame et al.
10,477,920 B2 11/2019 Henrichot et al.
10,508,373 B2 12/2019 Ngene et al.
10,512,296 B2 12/2019 Droege et al.
10,548,364 B2 2/2020 Podhajny
10,555,581 B2 2/2020 Bruce et al.
10,590,572 B2 3/2020 Koyabu et al.
10,674,791 B2 6/2020 Bruce et al.
10,694,817 B2 6/2020 Mcginnity et al.
D889,152 S 7/2020 Hecht et al.
10,703,068 B2 7/2020 Dua et al.
10,731,279 B2 8/2020 Cox et al.
10,743,618 B2 8/2020 Bruce et al.
10,791,791 B2 10/2020 Cox et al.
10,806,210 B2 10/2020 Bruce et al.
10,822,729 B2 11/2020 Dua et al.
10,834,992 B2 11/2020 Tamm et al.
10,874,220 B2 12/2020 Aldrich et al.
10,895,025 B2 1/2021 Manos-Gully et al.
10,905,189 B2 2/2021 Bruce et al.
10,907,282 B2 2/2021 Aceves Tinajero et al.
10,932,528 B2 3/2021 Bruce et al.
10,939,729 B2 3/2021 Tamm et al.
11,109,683 B2 9/2021 Deevers et al.
11,813,787 B2 * 11/2023 McGraw ..... B29C 45/14065
11,825,957 B2 * 11/2023 Aldrich ..... D03D 1/00
2003/0001420 A1 * 1/2003 Koepke ..... A47C 7/282 297/440.14
2003/0085607 A1 5/2003 Jones et al.
2004/0000173 A1 1/2004 Keller
2005/0025936 A1 2/2005 Snider et al.
2006/0207296 A1 9/2006 Fujikawa
2009/0224592 A1 * 9/2009 Chen ..... A47C 7/40 297/440.2
2009/0315384 A1 * 12/2009 Yang ..... A47C 7/282 297/452.47
2011/0169321 A1 * 7/2011 Jung ..... A47C 31/023 297/452.64
2012/0234052 A1 9/2012 Huffa et al.
2013/0260104 A1 10/2013 Dua et al.
2013/0295812 A1 * 11/2013 Lee ..... D04B 1/22 66/196
2014/0310983 A1 10/2014 Tamm et al.
2014/0310984 A1 10/2014 Tamm et al.
2014/0310985 A1 10/2014 Tran et al.
2015/0147517 A1 5/2015 Salzmann
2015/0223552 A1 8/2015 Love et al.
2016/0206102 A1 7/2016 Aldrich et al.
2016/0286898 A1 10/2016 Manz et al.
2016/0302508 A1 10/2016 Kormann et al.
2018/0127904 A1 5/2018 Adami et al.
2018/0146736 A1 5/2018 Koyabu et al.
2019/0037968 A1 2/2019 Dewillie et al.
2019/0069638 A1 3/2019 Lang et al.
2019/0082775 A1 3/2019 Tamm et al.
2019/0106037 A1 4/2019 Mankame et al.
2019/0208862 A1 7/2019 Poegl et al.
2019/0231021 A1 8/2019 Hoying et al.
2019/0335831 A1 11/2019 Urbelis

(56) References Cited

U.S. PATENT DOCUMENTS

| | | | |
|---|---|---|---|
| 2019/0390377 | A1 | 12/2019 | Macgilbert et al. |
| 2020/0046078 | A1 | 2/2020 | Durrell et al. |
| 2020/0113269 | A1 | 4/2020 | Tamm |
| 2020/0163414 | A1 | 5/2020 | Meir |
| 2020/0196700 | A1 | 6/2020 | Tamm et al. |
| 2020/0254912 | A1 | 8/2020 | Fujita et al. |
| 2020/0354866 | A1 | 11/2020 | Danby et al. |
| 2020/0399798 | A1 | 12/2020 | O'Sullivan |
| 2021/0030109 | A1 | 2/2021 | Frazier et al. |
| 2021/0180222 | A1 | 6/2021 | Kashima et al. |
| 2021/0401181 | A1 | 12/2021 | Putman |
| 2022/0034006 | A1 | 2/2022 | McGraw |

FOREIGN PATENT DOCUMENTS

| | | | |
|---|---|---|---|
| EP | 1193120 | A1 | 4/2002 |
| EP | 2436810 | A2 | 4/2012 |
| EP | 2474653 | A1 | 7/2012 |
| EP | 3470563 | A1 | 4/2019 |
| JP | 2006204661 | A | 8/2006 |
| JP | 2007016363 | A | 1/2007 |
| JP | 2007224441 | A | 9/2007 |
| JP | 3995631 | B2 | 10/2007 |
| JP | 2007277787 | A | 10/2007 |
| JP | 2009108465 | A | 5/2009 |
| JP | 4346921 | B2 | 10/2009 |
| JP | 4968168 | B2 | 7/2012 |
| JP | 5210028 | B2 | 6/2013 |
| JP | 2013256738 | A | 12/2013 |
| JP | 5414593 | B2 | 2/2014 |
| JP | 5709510 | B2 | 4/2015 |
| JP | 5895284 | B2 | 3/2016 |
| JP | 5963417 | B2 | 8/2016 |
| JP | 2017070465 | A | 4/2017 |
| JP | 2019157321 | A | 9/2019 |
| WO | 2004031025 | A1 | 4/2004 |
| WO | 2004088020 | A1 | 10/2004 |
| WO | 2004088021 | A1 | 10/2004 |
| WO | 2005040474 | A2 | 5/2005 |
| WO | 2005042818 | A1 | 5/2005 |
| WO | 2006011453 | A1 | 2/2006 |
| WO | 2006038465 | A1 | 4/2006 |
| WO | 2008143172 | A1 | 11/2008 |
| WO | 2009084427 | A1 | 7/2009 |
| WO | 2011035285 | A2 | 3/2011 |
| WO | 2014119029 | A1 | 8/2014 |
| WO | 2014121923 | A1 | 8/2014 |
| WO | 2019082876 | A1 | 5/2019 |

OTHER PUBLICATIONS

Camira, "Camira Knit," <https:www/camirafabrics.com/US/our-expertise/camira-knit> web page visited Oct. 4, 2021 (9 pages).
Kobleder, "Innovative Knitted Fabrics for Seating and Upholstery Applications," <kttps://kobleder.at/en/seating/> web page visited Oct. 18, 2021 (5 pages).
Erasmus+, "Knitting Technology," guide © 2018 (22 pages).
Knitmasters, product sheet dated Mar. 2008 (1 page).

* cited by examiner

SEATING STRUCTURE HAVING A KNITTED SUSPENSION MATERIAL

CROSS-REFERENCE TO RELATED APPLICATION

This application claims priority to U.S. Provisional Patent Application No. 63/405,088, filed Sep. 9, 2022, the entire contents of which are incorporated herein by reference.

BACKGROUND

The present invention relates to furniture items having knitted suspension materials, and more specifically, seating structures having knitted suspension materials.

SUMMARY

In one embodiment, an article of furniture includes a frame defining an opening, and a suspension material spanning over the opening and having a weft knit construction. The suspension material is configured to support a user, and the suspension material includes at least one multifilament forming a jersey knit structure which has a plurality of courses extending in a course direction and a plurality of wales extending in a wale direction, and at least one monofilament corresponding to and being inlaid in a respective one of the courses. The suspension material has, in the course direction, a ratio of machine gauge, in needles per mm, to course stiffness, in N per mm, between 0.02 and 0.2 and has, in the wale direction, a ratio of machine gauge, in needles per mm, to wale stiffness, in N per mm, between 0.07 and 1.4.

In another embodiment, the disclosure provides an article of furniture includes a frame defining an opening, and a suspension material spanning over the opening and having a weft knit construction. The suspension material is configured to support a user and includes at least one multifilament forming a jersey knit structure which has a plurality of courses extending in a course direction and a plurality of wales extending in a wale direction, and at least one monofilament corresponding to and being inlaid in a respective one of the courses. The at least one monofilament has a ratio of machine gauge, in needles per mm, to stiffness, in N per mm, between 0.5 and 2.6, and has a ratio of machine gauge, in needles per inch, to linear density, in denier, between 0.005 and 0.02.

In another embodiment, the disclosure provides a suspension material for use with an article of furniture. The suspension material includes at least one multifilament and at least one monofilament. The at least one multifilament forms a jersey knit structure which has a plurality of courses extending in a course direction and a plurality of wales extending in a wale direction. The at least one monofilament corresponds to and is inlaid in a respective one of the courses. The at least one monofilament has a ratio of machine gauge, in needles per mm, to stiffness, in N per mm, between 0.5 and 2.6, and has a ratio of machine gauge, in needles per inch, to linear density, in denier, between 0.005 and 0.02. The suspension material has, in the course direction, a ratio of machine gauge, in needles per mm, to course stiffness, in N per mm, between 0.02 and 0.2 and has, in the wale direction, a ratio of machine gauge, in needles per mm, to wale stiffness, in N per mm, between 0.07 and 1.4.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Various exemplary embodiments are related to seating structures and methods of manufacturing seating structures. Seating structures may include any structure used to support a body of a user, for example, without limitation, task chairs, side chairs, sofas, airplane seats, vehicle seats, bicycle seats, boat seats, beds, dental and medical seats and beds, auditorium and educational seats, etc. It should be understood that the various methods and devices disclosed herein may be applied to seating structures other than a seat and/or backrest, including for example and without limitation armrests, headrests and other ergonomic positioning features. Although the illustrated embodiments are shown in connection with an office chair, other embodiments can include different configurations.

Figure 1:
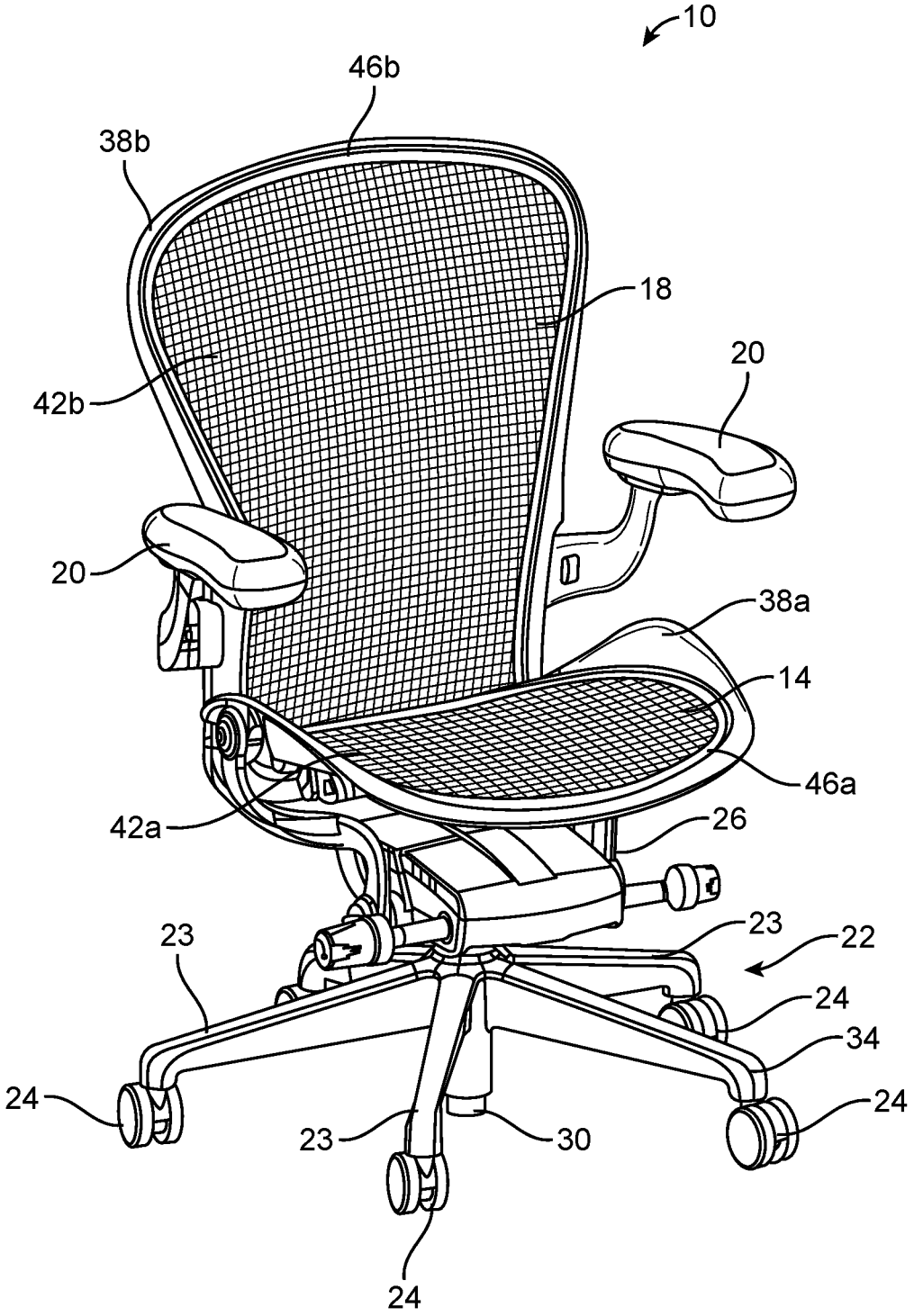
FIG. 1 is a perspective view of a seating structure according to some embodiments.

FIG. 1 shows an exemplary embodiment of a seating structure 10, such as a chair. The illustrated embodiment is only one example of a configuration of a chair. The chair may have other shapes and/or configurations. The seating structure 10 may also be a different type of furniture item, such as a bench, sofa, settee, chaise, ottoman, bed, cot, and the like. In the illustrated embodiment, the seating structure 10 is an office chair.

The seating structure 10 includes a seat 14, a backrest 18, and a base 22. In the illustrated embodiment, the seating structure 10 includes armrests 20. In other embodiments, the seating structure 10 may not include armrests. The base 22 includes a tilt mechanism 26, a support column 30 coupled to and supporting the tilt mechanism 26, and a base structure 34 coupled to and supporting the support column 30. In other embodiments, the seating 14 and/or backrest 18 may be rigidly coupled to the support column 30 or base 22. In the illustrated embodiment, the base 22 includes five feet 23 surrounding a central hub. Each of the feet 23 is coupled to a castor wheel 24. In some embodiments, the base 22 may include glides instead of castor wheels. In other embodiments, the base 22 may include a plurality of legs. In such embodiments, the support column 30 and/or the tilt mechanism 26 may be omitted.

The seat 14 includes a frame 38*a*, a suspension member 42*a*, and a carrier 46*a*. The carrier 46*a* retains the suspension member 42*a* and connects to the frame 38*a*. In other embodiments, the suspension member 42*a* may be directly coupled to the frame 38*a*. The frame 38*a* defines an opening, and the suspension member 42*a* spans over the opening. The suspension member 42*a* is configured to support a weight of a user.

Likewise, the backrest 18 includes a frame 38*b*, a suspension member 42*b*, and a carrier 46*b*. In some embodiments, only one suspension member and one frame may be used to form a continuous seat and backrest. In the illustrated embodiment, the carrier 46*b* retains the suspension member 42*b* and connects to the frame 38*b*. The suspension member 42*b* extends across the frame 38*b* to support a user on the seating structure 10. In other embodiments, the suspension member 42*b* may be directly coupled to the frame 38*b*. The frame 38*b* defines an opening, and the suspension member 42*b* spans over the opening. The suspension member 42*b* is configured to support a back of a user.

Fabric Construction and Composition

Figure 2:
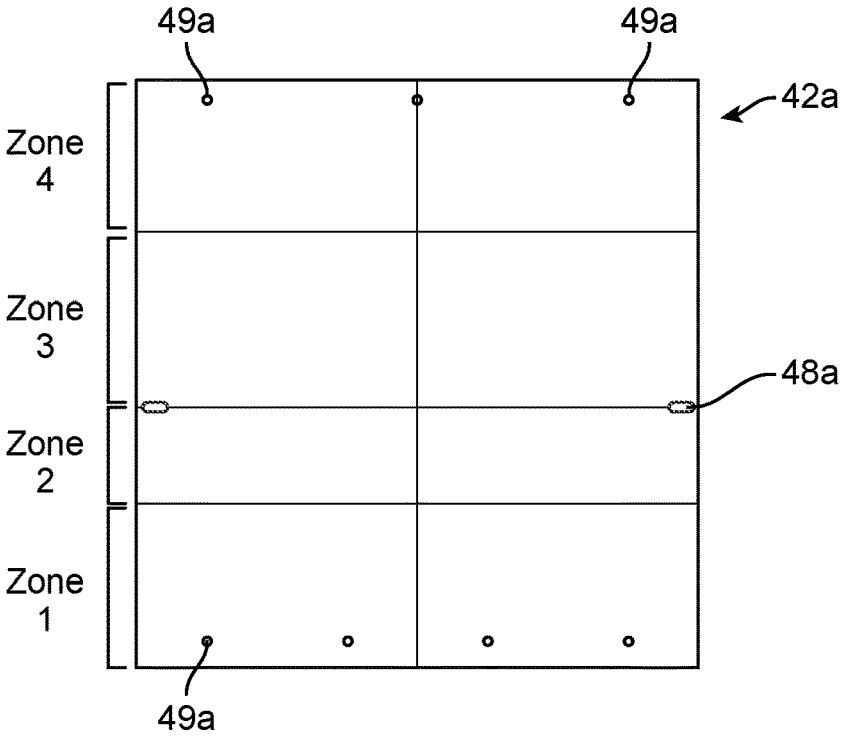
FIG. 2 is a plan view of a suspension material of a seat of the seating structure shown in FIG. 1.
Figure 3:
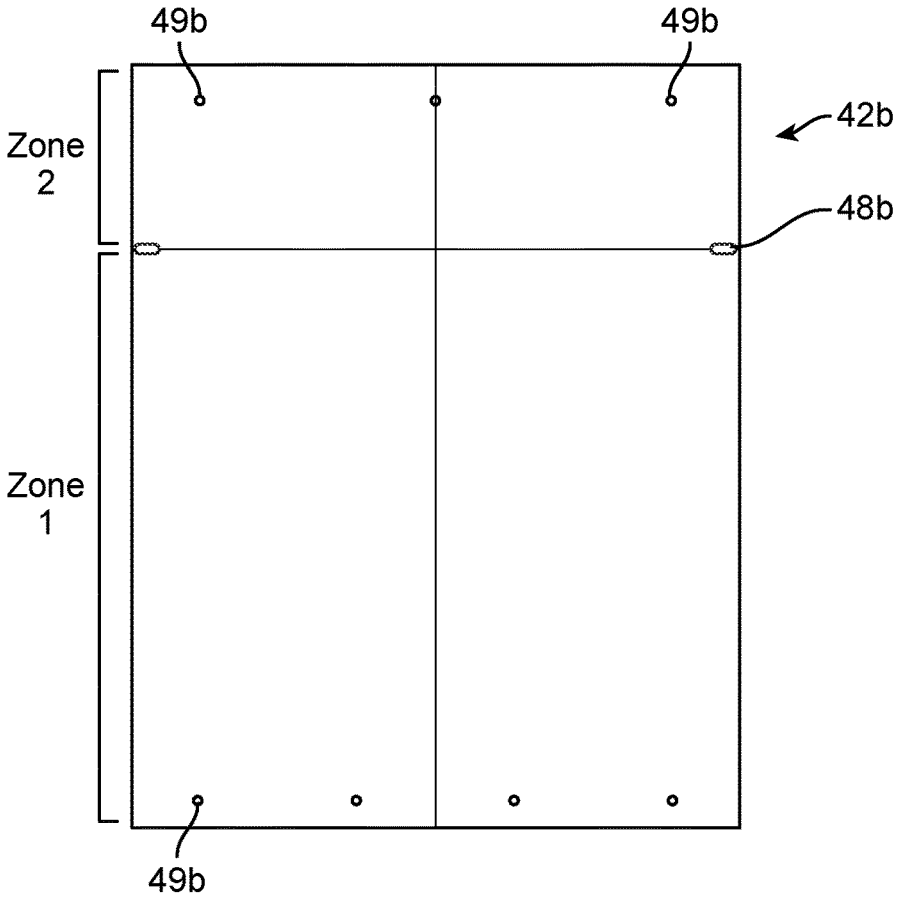
FIG. 3 is a plan view of a suspension material of a backrest of the seating structure shown in FIG. 1.

As illustrated in FIGS. 2 and 3, the suspension members 42*a*, 42*b* are panels or sheets and are formed from a suspension material. The suspension members 42*a*, 42*b* have a weft knit construction. For example, the suspension members 42*a*, 42*b* may have a single jersey knit construction or a double jersey knit construction. The double jersey knit construction may be a double jersey interlock, a double jersey non-interlock, or a double jersey mis-stitched. In some embodiments, the suspension members 42*a*, 42*b* may have a combination of single jersey knit sections and double jersey knit sections. The suspension members 42*a*, 42*b* may be formed from a weft knitting machine, such as a V-bed machine or a flat-bed machine. As a result, the suspension members 42*a*, 42*b* may be formed without excess fabric. That is, the suspension members 42*a*, 42*b* can be produced to finished application shape and size with no cutting or sewing required. In other embodiments, the suspension members 42*a*, 42*b* may have a warp knit structure, a circular knit structure, and/or a flat knit structure.

Figure 4:
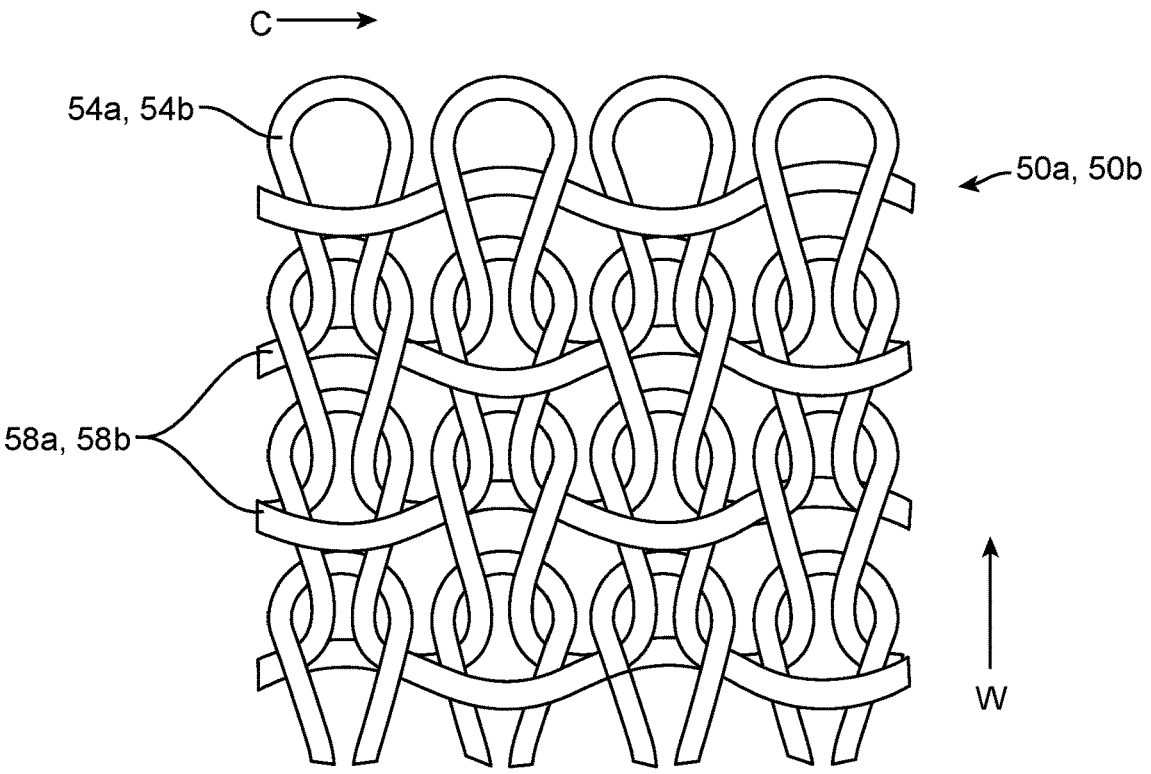
FIG. 4 is an enlarged view of a single jersey with tunnel inlay suspension material for use with the seating structure shown in FIG. 1.
Figure 5:
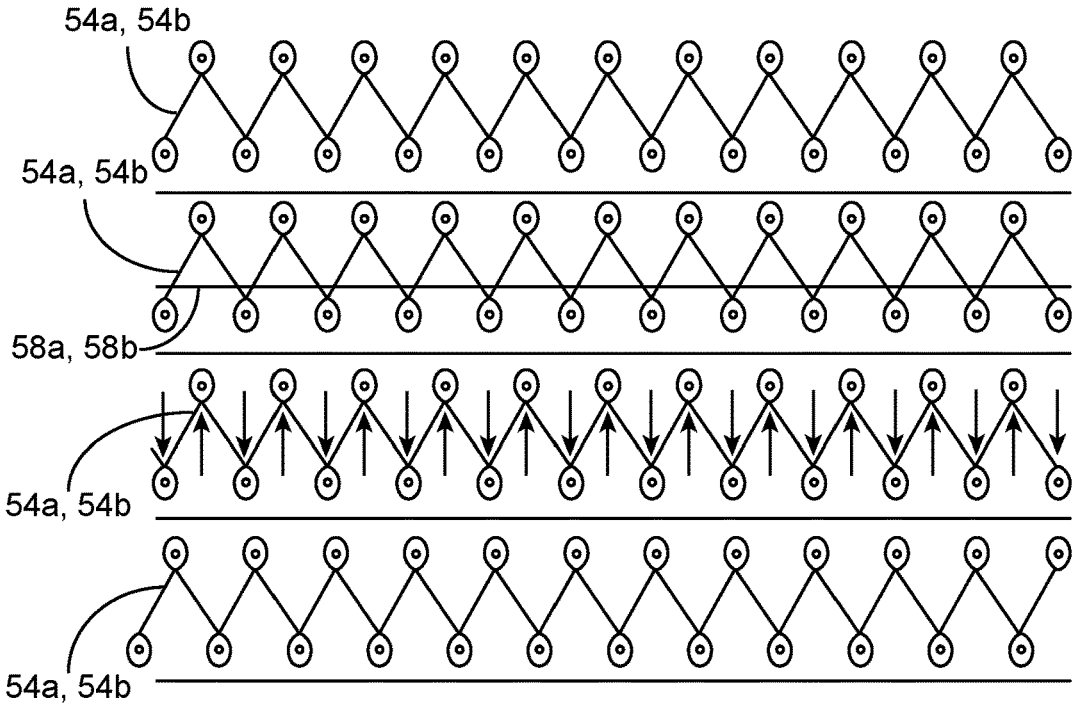
FIG. 5 is a dot diagram of the suspension materials of the seating structure shown in FIG. 1.

FIGS. 4 and 5 illustrate a single jersey knit and tunnel inlay structures 50*a*, 50*b* of the suspension members 42*a*, 42*b*. Each single jersey knit structure 50*a*, 50*b* has a multifilament 54*a*, 54*b* and a plurality of monofilaments 58*a*, 58*b*. In some embodiments, the single jersey knit structure may include a plurality of multifilaments. Each of the multifilaments 54*a*, 54*b* forms a respective one of the jersey knit structures and has a plurality of courses extending in a course direction C and a plurality of wales extending in a wale direction W. The plurality of monofilaments 58*a*, 58*b* each correspond to and are inlaid in a respective one of the courses. Each of the plurality of monofilaments 58*a*, 58*b* extends in the course direction C. In the illustrated embodiment, every course includes an inlaid one of the monofilaments 58*a*, 58*b*. In some embodiments, only some of the courses may include an inlaid one of the monofilaments 58*a*, 58*b*. In some embodiments, the monofilaments 58*a*, 58*b* may be inlaid in the wales and may extend in the wale direction W.

Fabric Specification

Referring back to FIGS. 2 and 3, the suspension members 42*a*, 42*b* have a heat finish such as a steam finish. The suspension members 42*a*, 42*b* may have a machine gauge between 5 and 20 ga, specifically between 10 and 18 ga, and more specifically between 12 and 16 ga. In the illustrated embodiment, the suspension members 42*a*, 42*b* have a machine gauge of 14 ga. Machine gauge should be understood to mean a number of needles per inch. The monofilaments 58*a*, 58*b* define end counts of the suspension members 42*a*, 42*b*. End count should be understood to mean the number of monofilaments in the course direction. The end counts may be between 5 and 30 ends per inch, specifically between 11 and 25 ends per inch, and more specifically between 16 and 20 ends per inch. In the illustrated embodiment, the end counts are 18 ends per inch or 7 ends per centimeter. In some embodiments, the end counts may be between 5 and 9 ends per centimeter. The end counts may vary based on the gauge (e.g., needles per inch, or needles per mm, etc.) of the knitting machine used to create the suspension member 42*a*, 42*b*. As such, the suspension members 42*a*, 42*b* may have a ratio of machine gauge (in needles per mm) to inlaid monofilament count (in ends per mm) between 0.6 and 1.4. The suspension members 42*a*, 42*b* may have a fabric weight between 315 $g/m^2$ and 945 $g/m^2$, specifically between 475 $g/m^2$ and 790 $g/m^2$, and more specifically between 550 $g/m^2$ and 700 $g/m^2$. In the illustrated embodiment, the suspension members 42*a*, 42*b* have a weight of 630 $g/m^2$.

In the course direction C, the suspension members 42*a*, 42*b* may have a tensile force between 65 N and 200 N at 10% strain, specifically between 100 N and 160 N at 10% strain, and more specifically between 117 N and 141 N at 10% strain. In the illustrated embodiment, the suspension members 42*a*, 42*b* have a tensile force in the course direction C of 129 N at 10% strain. The suspension members 42*a*, 42*b* may have a tensile force in the course direction C between 115 N and 345 N at 20% strain, specifically between 175 N and 290 N at 20% strain, and more specifically between 207 N and 253 N at 20% strain. In the illustrated embodiment, the suspension members 42*a*, 42*b* have a tensile force in the course direction C of 230 N at 20% strain. The suspension members 42*a*, 42*b* may have an ultimate tensile strength in the course direction C of at least 300 N, specifically at least 450 N, and more specifically at least 500 N. In the illustrated embodiment, the suspension members 42*a*, 42*b* each have an ultimate tensile strength in the course direction C of at least 598 N. The ultimate tensile strength in the course direction C should be understood to mean the maximum force that the suspension member can withstand while being stretched in the course direction C before breaking.

Additionally, in the course direction C, the suspension members 42*a*, 42*b* may have a stiffness between 8 N/mm and 25 N/mm, specifically between 12 N/mm and 20 N/mm, and more specifically 13.5 N/mm and 17.5 N/mm. In the illustrated embodiment, the suspension members 42*a*, 42*b* have a stiffness of 15 N/mm in the course direction C. The stiffness may vary based on the gauge (e.g., needles per inch, or needles per mm, etc.) of the knitting machine used to create the suspension member 42*a*, 42*b*. As such, the suspension members 42*a*, 42*b* may have a ratio of machine gauge (in needles per mm) to course stiffness (in N per mm) between 0.02 and 0.2. In the course direction C, the suspension members 42*a*, 42*b* have at least 80% strain at break, specifically at least 90% strain at break, and more specifically at least 100% strain at break.

In the wale direction W, the suspension members 42*a*, 42*b* may have a tensile force between 15 N and 35 N at 10% strain, specifically between 20 N and 30 N at 10% strain, and more specifically between 22 N and 26 N at 10% strain. In the illustrated embodiment, the suspension members 42*a*, 42*b* have a tensile force in the wale direction W of 24 N at 10% strain. The suspension members 42*a*, 42*b* may have a tensile force in the wale direction W between 25 N and 70 N at 20% strain, specifically between 35 N and 60 N at 20% strain, and more specifically between 42 N and 52 N at 20% strain. In the illustrated embodiment, the suspension members 42*a*, 42*b* have a tensile force in the wale direction W of 47 N at 20% strain. The suspension members 42*a*, 42*b* may have an ultimate tensile strength in the wale direction W of at least 300 N, specifically at least 350 N, and more specifically at least 400 N. In the illustrated embodiment, the suspension members 42*a*, 42*b* have an ultimate tensile strength in the wale direction W of at least 415 N. The ultimate tensile strength in the wale direction W should be understood to mean the maximum force that the suspension member can withstand while being stretched in the wale direction W before breaking.

Additionally, in the wale direction W, the suspension members 42*a*, 42*b* may have a stiffness between 1.5 N/mm and 4.5 N/mm, specifically between 2 N/mm and 4 N/mm, and more specifically 2.25 N/mm and 3.75 N/mm. In the illustrated embodiment, the suspension members 42*a*, 42*b* have a stiffness of 4.55 N/mm in the wale direction W. The stiffness may vary based on the gauge (e.g., needles per inch, or needles per mm, etc.) of the knitting machine used to create the suspension member 42*a*, 42*b*. As such, the suspension members 42*a*, 42*b* may have a ratio of machine gauge (in needles per mm) to wale stiffness (in N per mm) between 0.07 and 1.4. In the wale direction W, the suspension members 42*a*, 42*b* may have at least a 100% strain at break, specifically at least 125% strain at break, and more specifically at least 150% strain at break.

Monofilament Specification and Composition

The plurality of monofilaments 58*a*, 58*b* are the primary load bearing members of the suspension members 42*a*, 42*b*. The plurality of monofilaments 58*a*, 58*a* may be bicomponent monofilaments and include a thermoplastic polyester elastomer. The plurality of monofilaments 58*a*, 58*a* may have an elliptical cross section. Each of the monofilaments 58*a*, 58*a* may have a width of at least 0.4 mm, specifically at least 0.5 mm, and more specifically at least 0.6 mm. Each of the monofilaments 58*a*, 58*a* may have a height of at least 0.3 mm, and specifically at least 0.4 mm. Each of the monofilaments 58*a*, 58*a* may have a linear density between 760 denier and 2900 denier, specifically between 1900 denier and 2300 denier, and more specifically between 2000 denier and 2200 denier. In the illustrated embodiment, each of the monofilaments 58*a*, 58*b* has a linear density of 2100 denier. The linear density may vary based on the gauge (e.g., needles per inch, or needles per mm, etc.) of the knitting machine used to create the suspension member 42*a*, 42*b*. As such, the monofilaments 58*a*, 58*b* may have a ratio of machine gauge (in needles per inch) to linear density (in denier) between 0.005 and 0.02. Linear density should be understood to mean mass per unit length of a filament or along a flow path of filaments.

Each of the monofilaments 58*a*, 58*b* may have a tensile force between 3 N and 10 N at 10% strain and specifically between 4.4 N and 9 N at 10% strain. Each of the monofilaments 58*a*, 58*b* may have a tensile force of 6.7 N at 10% strain. Each of the monofilaments 58*a*, 58*b* may have a tensile force between 9 N and 22 N at 20% strain and specifically between 11.7 N and 19.7 N at 20% strain. Each of the monofilaments 58*a*, 58*b* may have a tensile force of 15.7 N at 20% strain. Each tensile force and strain is along the length of a respective one of the monofilaments. Each of the monofilaments 58*a*, 58*b* may have an ultimate tensile strength of at least 15 N, specifically at least 20 N, and more specifically at least 22 N. The ultimate tensile strength of the monofilament should be understood to mean the maximum force that the monofilament can withstand while being stretched along the length of the monofilament before breaking. Each of the monofilaments 58*a*, 58*b* may have a stiffness between 0.5 N/mm and 1.5 N/mm, specifically between 0.75 N/mm and 1.25 N/mm, and more specifically between 0.9 N/mm and 1.1 N/mm. Each of the monofilaments 58*a*, 58*b* may have a stiffness of 1 N/mm. Similar to the linear density, the stiffness may vary based on the gauge (e.g., needles per inch, or needles per mm, etc.) of the knitting machine used to create the suspension member 42*a*, 42*b*. As such, monofilaments 58*a*, 58*b* may have a ratio of machine gauge (in needles per mm) to stiffness (in N per mm) between 0.5 and 2.6. Each of the monofilaments 58*a*, 58*b* may have between a 40% strain and 135% strain at break, specifically between 50% strain and 120%, and more specifically between 55% and 115%.

Multifilament Specification and Composition

The multifilaments 54*a*, 54*b* may be high tenacity, fully drawn yarns. In some embodiments, the multifilaments 54*a*, 54*b* may be air jet textured and have round cross-sections. The multifilaments 54*a*, 54*b* may be made of polyester. Each of the multifilaments 54*a*, 54*b* may have a linear density between 825 denier and 1225 denier, specifically between 850 denier and 1200 denier, and more specifically between 925 denier and 1125 denier. Each of the multifilaments 54*a*, 54*b* may have a linear density of 1025 denier. The linear density is the total linear density of the yarn being knitted. In embodiments where multiple yarns are used, the combined denier of the yarns may be the linear density. For example, in some embodiments, two 440 denier yarns may be used such that the multifilaments have a linear density of 880 denier. Each of the multifilaments 54*a*, 54*b* may have a filament count between 700 and 900 and specifically between 750 and 850. Each of the multifilaments 54*a*, 54*b* may have a filament count of 816. Filament count should be understood to mean the number of single filaments in a cross-section view of a single strand of multifilament. The cross-section view is perpendicular to length of the single strand of multifilament. Each filament of the multifilaments 54*a*, 54*b* may have a linear density between 0.6 denier and 2 denier, specifically between 1 denier and 1.5 denier, and more specifically between 1.2 denier and 1.4 denier. Each filament of the multifilaments 54*a*, 54*b* may have a linear density of 1.3 denier. The linear density may vary based on the gauge (e.g., needles per inch, or needles per mm, etc.) of the knitting machine used to create the suspension member 42*a*, 42*b*. As such, the multifilaments may have a ratio of machine gauge (in needles per inch) to linear density (in denier) between 0.01 and 0.03.

Each of the multifilaments 54*a*, 54*b* may have a stiffness between 0.8 N/mm and 1.1 N/mm. Similar to the linear density, the stiffness may vary based on the gauge (e.g., needles per inch, or needles per mm, etc.) of the knitting machine used to create the suspension member 42*a*, 42*b*. As such, the multifilaments 54*a*, 54*b* may have a ratio of machine gauge (in needles per mm) to stiffness (in N per mm) between 0.5 and 0.7.

Each of the multifilaments 54*a*, 54*b* may also have a tensile force between 3 N and 10 N at 10% strain and specifically between 4.4 N and 9 N at 10% strain. Each of the multifilaments 54*a*, 54*b* may have a tensile force of 6.7 N at 10% strain. Each of the multifilaments 54*a*, 54*b* may have a tensile force between 9 N and 22 N at 20% strain and specifically between 11.7 N and 19.7 N at 20% strain. Each of the multifilaments 54*a*, 54*b* may have a tensile force of 15.7 N at 20% strain. Each of the multifilaments 54*a*, 54*b* may have at least a 10% strain at break, specifically at least a 20% strain at break, and more specifically at least a 30% strain at break. Each tensile force and strain is along the length of a respective one of the multifilaments. Each of the multifilaments 54*a*, 54*b* may have an ultimate tensile strength of at least 15 N, specifically at least 18 N and more specifically at least 22 N. The ultimate tensile strength of the multifilament should be understood to mean the maximum force that the multifilament can withstand while being stretched along the length of the multifilament before breaking. Each of the multifilaments 54*a*, 54*b* may have a toughness of at least 50 kgf/mm, specifically at least 60 kgf/mm, and more specifically at least 66 kgf/mm. Toughness should be understood to mean the work capacity of the multifilament yarn (i.e., the area under the tensile curve of the multifilament yarn).

Suspension Member

Referring back to FIGS. 2 and 3, the suspension members 42*a*, 42*b* are flat panels and have slots 48*a*, 48*b* and openings 49*a*, 49*b* before the suspension members 42*a*, 42*b* are coupled to the carriers 46*a*, 46*b*. The slots 48*a*, 48*b* and the openings 49*a*, 49*b* are positioning features that help properly position the suspension members 42*a*, 42*b* during manufacturing. For example, the slots 48*a*, 48*b* and/or the openings 49*a*, 49*b* may provide visual cues to help align the suspension members 42*a*, 42*b*. The slots 48*a*, 48*b*, and the openings 49*a*, 49*b* may also provide areas for a tool to grasp or engage the suspension members 42*a*, 42*b*. In some embodiments, the suspension members 42*a*, 42*b* may have knitted pockets. In some embodiments, the suspension members 42*a*, 42*b* may have knitted tubes. In some embodiments, the suspension members 42*a*, 42*b* may have knitted loops. In some embodiments, the knit structures 50*a*, 50*b* of the seat 14 and the backrest 18 may be identical. In other embodiments, the seat 14 may have different characteristics from the backrest 18, such as a higher stiffness and a higher strength. The suspension members 42*a*, 42*b* have different dimensions and may be shaped to conform to the different shapes of the carriers 46*a*, 46*b* and frames 42*a*, 42*b*. As illustrated in FIGS. 2 and 3, the suspension members 42*a*, 42*b* have slots 48*a*, 48*b* and openings 49*a*, 49*b*. In some embodiments, the suspension members 42*a*, 42*b* may have knitted pockets. In some embodiments, the suspension members 42*a*, 42*b* may have knitted tubes. In some embodiments, the suspension members 42*a*, 42*b* may have knitted loops.

In some embodiments, the suspension members 42*a*, 42*b* may be homogenous such that the suspension members 42*a*, 42*b* each have a constant color, a constant knit and constant material properties across the areas of the suspension members 42*a*, 42*b*. In some embodiments, the suspension member 42*a*, 42*b* can include different zones, which each have different characteristics. The zones of the suspension members 42*a*, 42*b* can be aligned within the carriers 46*a*, 46*b* in order to achieve a designated purpose. For example, in one embodiment, the zones are designated to have different levels of stiffness to increase the comfort and/or support of the seating structure for a user. The zones can then be aligned within the carrier 46*a*, 46*b* so that the zones having greater stiffness are positioned in locations where more support is desired, and the zones having greater flexibility are positioned in locations were greater comfort is desired. In another embodiment, the zones can have different patterns, knits, or colors. In some embodiments, the zones can be arranged within the carriers 46*a*, 46*b* to create a certain aesthetic appearance.

Additional Fabric Construction and Composition

Figure 6:
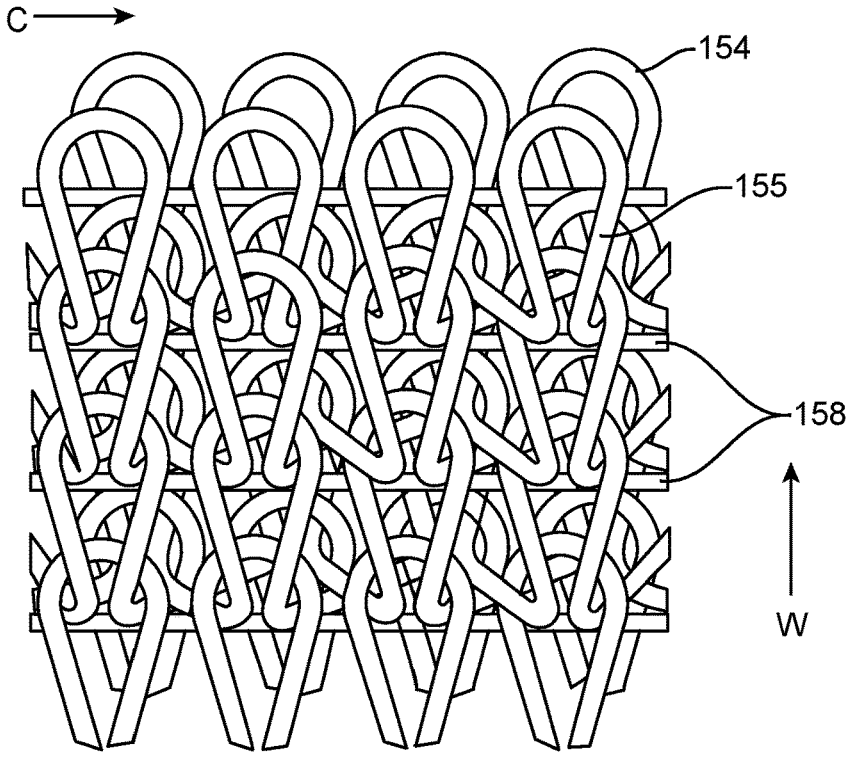
FIG. 6 is an enlarged view of a double jersey interlock with tunnel inlay suspension material for use with the seating structure shown in FIG. 1.
Figure 7:
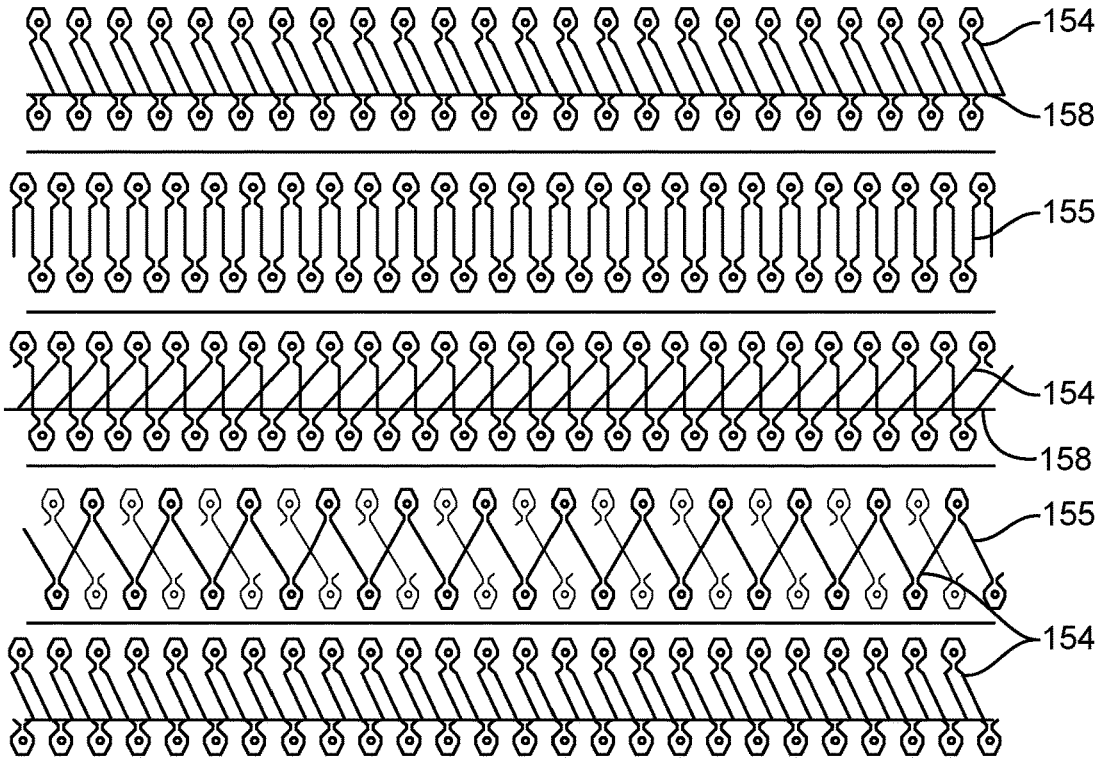
FIG. 7 is a dot diagram of the suspension material shown in FIG. 6.

FIGS. 6 and 7 illustrate another knit structure 150 of a suspension member 142. The suspension member 142 is similar to the suspension members 42*a*, 42*b* discussed above and includes a plurality of multifilaments 154, 155 and plurality of monofilaments 158. The suspension member 142 may be used to form either a seat or a backrest. Unlike the suspension member 42 discussed above, the suspension member 142 has a double jersey interlock knit structure with a tunnel inlay.

The suspension member 142 may have a fabric weight between 800 g/m$^2$ and 1200 g/m$^2$, specifically between 900 g/m$^2$ and 1100 g/m$^2$, and more specifically between 1000 g/m$^2$ and 1050 g/m$^2$. In the illustrated embodiment, the suspension member 142 has a weight of 1017 g/m$^2$.

In the course direction C, the suspension member 142 may have a tensile force between 71 N and 213 N at 10% strain, specifically between 106 N and 178 N at 10% strain, and more specifically between 132 N and 152 N at 10% strain. In the illustrated embodiment, the suspension member 142 has a tensile force in the course direction C of 1142 N at 10% strain. The suspension member 142 may have a tensile force in the course direction C between 135 N and 405 N at 20% strain, specifically between 202 N and 338 N at 20% strain, and more specifically between 240 N and 300 N at 20% strain. In the illustrated embodiment, the suspension member 142 has a tensile force in the course direction C of 270 N at 20% strain. The suspension member 142 may have an ultimate tensile strength in the course direction C of at least 500 N, specifically at least 650 N, and more specifically at least 750 N. In the illustrated embodiment, the suspension member 142 has an ultimate tensile strength in the course direction C of at least 785 N.

Additionally, in the course direction C, the suspension member 142 may have a stiffness between 10 N/mm and 25 N/mm, specifically between 13 N/mm and 23 N/mm, and more specifically 16 N/mm and 20 N/mm. In the illustrated embodiment, the suspension member 142 has a stiffness of 18 N/mm in the course direction C. In the course direction C, the suspension member 142 may have at least a 90% strain at break, specifically at least 100% strain at break, and more specifically at least 107% strain at break.

In the wale direction W, the suspension member 142 may have a tensile force between 20 N and 60 N at 10% strain, specifically between 30 N and 50 N at 10% strain, and more specifically between 36.5 N and 43.5 N at 10% strain. In the illustrated embodiment, the suspension member 142 has a tensile force in the wale direction W of 40 N at 10% strain. The suspension member 142 may have a tensile force in the wale direction W between 40 N and 122 N at 20% strain, specifically between 60 N and 102 N at 20% strain, and more specifically between 73 N and 89 N at 20% strain. In the illustrated embodiment, the suspension member 142 has a tensile force in the wale direction W of 81 N at 20% strain. The suspension member 142 may have an ultimate tensile strength in the wale direction W of at least 500N, specifically at least 600N, and more specifically at least 650N. In the illustrated embodiment, the suspension member 142 has an ultimate tensile strength in the wale direction W of at least 697N.

Additionally, in the wale direction W, the suspension member 142 may have a stiffness between 2 N/mm and 8 N/mm, specifically between 4 N/mm and 7 N/mm, and more specifically 4.55 N/mm and 6.05 N/mm. In the illustrated embodiment, the suspension member 142 has a stiffness of 5.3 N/mm in the wale direction W. In the wale direction W, the suspension member 142 may have at least a 100% strain at break, specifically at least 120% strain at break, and more specifically at least 130% strain at break.

The quantities of the present application may be measured per ASTM D5034-09 and per ASTM D2256.

The above properties and constructions allow the suspension materials 42*a*, 42*b*, 142*a*, 142*b* to support a user, and preferably a user in a seat. A fabric having one or more of the above discussed characteristics, may be suitable to support a user, and preferably a user in a seat. Because the suspension materials 42*a*, 42*b*, 142*a*, 142*b* are 3D knit, the suspension materials 42*a*, 42*b*, 142*a*, 142*b* may be made into the exact or near-exact shape of the seat and/or backrest and do not require excess trimming. As such, the 3D-knit suspension materials 42*a*, 42*b*, 142*a*, 142*b* generate less waste compared to woven suspension materials. Because the suspension materials 42*a*, 42*b*, 142*a*, 142*b* are 3D-knit, the suspension materials 42*a*, 42*b*, 142*a*, 142*b* may be formed "on-demand," or one at a time, rather than in bulk. As a result, the suspension materials 42*a*, 42*b*, 142*a*, 142*b* may be made-to-order. For example, the suspension materials 42*a*, 42*b*, 142*a*, 142*b* may be individually made for each user in different colors, patterns, shapes, and/or sizes.

Figure 9:
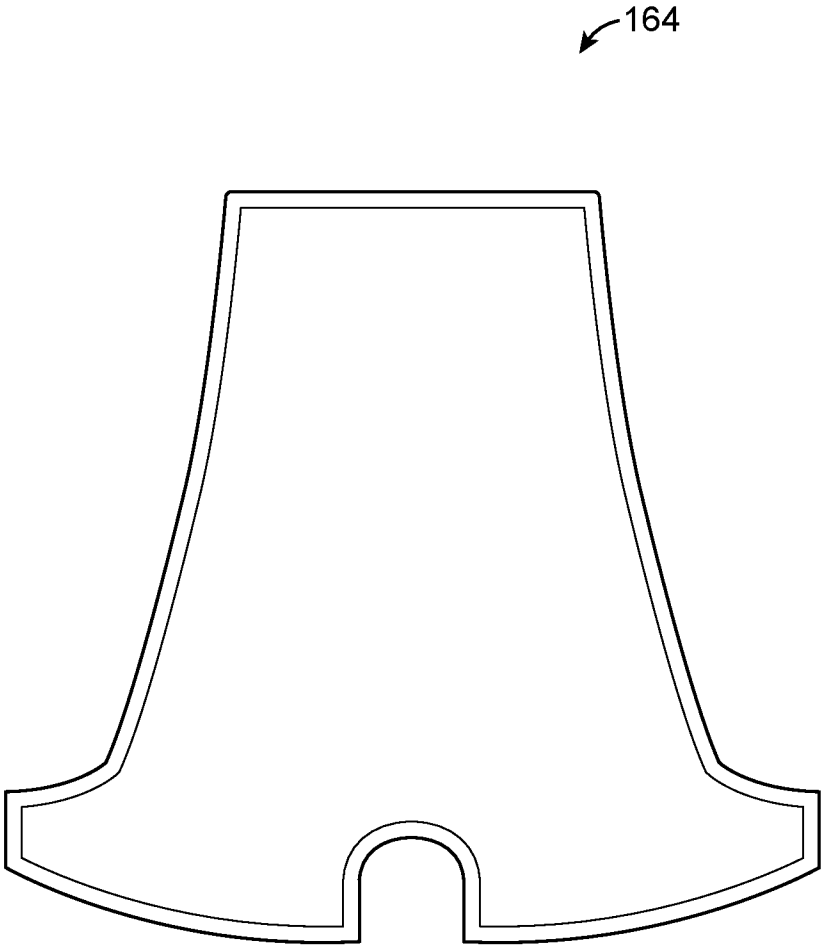
FIG. 9 is a plan view a second suspension material for use with a backrest of a seating structure.
Figure 8:
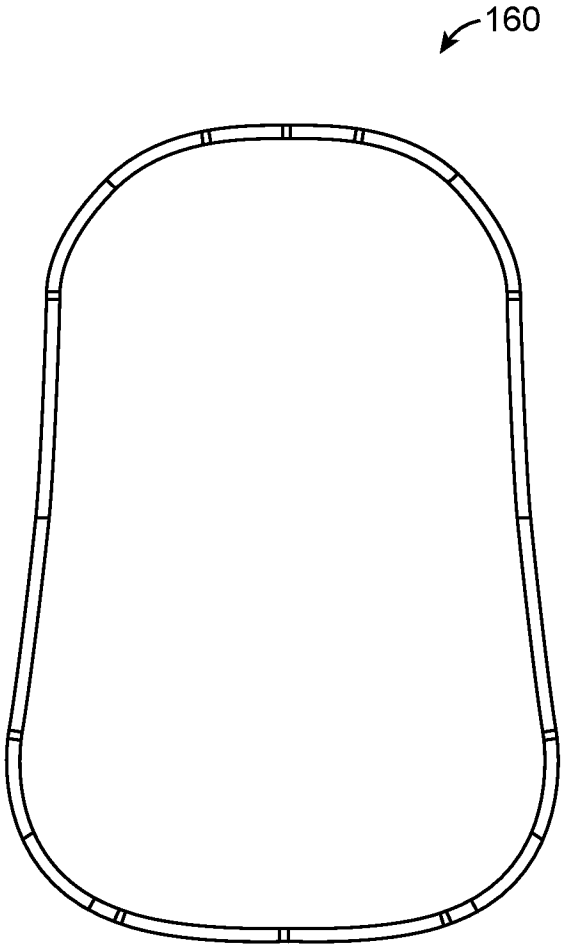
FIG. 8 is a plan view of a first suspension material for use with a backrest of a seating structure.

FIGS. 8 and 9 illustrate two examples of suspension materials 160, 164 that can be made using the above knitting techniques and properties for chair backrests. The suspension material 160 shown in FIG. 8 has an oblong rounded shape and is made in the near-exact shape of the Mirra® chair backrest sold by Herman Miller. The suspension material 164 shown in FIG. 9 has a partial trapezoidal shape with wings and is made in the near-exact shape of the Sayl® chair backrest sold by Herman Miller. Other shapes are also possible using the weft knitting processes to reduce waste during manufacture.

Various features and advantages of the invention are set forth in the following claims.

What is claimed is:

1. An article of furniture comprising:

a frame defining an opening; and a suspension material spanning over the opening and having a weft knit construction, the suspension material configured to support a user, the suspension material including:

at least one multifilament forming a jersey knit structure which has a plurality of courses extending in a course direction and a plurality of wales extending in a wale direction, and at least one monofilament corresponding to and being inlaid in a respective one of the courses, wherein the suspension material has, in the course direction, a ratio of machine gauge, in needles per mm, to course stiffness, in N per mm, between 0.02 and 0.2 and has, in the wale direction, a ratio of machine gauge, in needles per mm, to wale stiffness, in N per mm, between 0.07 and 1.4.

2. The article of furniture of claim 1, wherein the suspension material has a ratio of machine gauge, in needles per mm, to inlaid monofilament count, in ends per mm, between 0.6 and 1.4.

3. The article of furniture of claim 1, wherein the suspension material is heat-finished.

4. The article of furniture of claim 1, wherein the at least one monofilament is one of a plurality of monofilaments, and wherein each of the plurality of monofilaments is inlaid in a corresponding one of the plurality of courses such that each of the courses includes an inlaid monofilament.

5. The article of furniture of claim 1, wherein the suspension material has a double jersey knit construction.

6. The article of furniture of claim 1, wherein the suspension material has a single jersey knit construction.

7. The article of furniture of claim 1, wherein the suspension material has a course stiffness of at least 8 N per mm.

8. The article of furniture of claim 1, wherein the suspension material has a wale stiffness of at least 1.5 N per mm.

9. The article of furniture of claim 1, wherein the suspension material has an ultimate tensile strength in the course direction of at least 300 N, and wherein the suspension material has an ultimate tensile strength in the wale direction of at least 300 N.

10. An article of furniture comprising:

a frame defining an opening; and a suspension material spanning over the opening and having a weft knit construction, the suspension material configured to support a user, the suspension material including:

at least one multifilament forming a jersey knit structure which has a plurality of courses extending in a course direction and a plurality of wales extending in a wale direction, and at least one monofilament corresponding to and being inlaid in a respective one of the courses, the at least one monofilament having a ratio of machine gauge, in needles per mm, to stiffness, in N per mm, between 0.5 and 2.6, and having a ratio of machine gauge, in needles per inch, to linear density, in denier, between 0.005 and 0.02.

11. The article of furniture of claim 10, wherein the at least one multifilament has a ratio of machine gauge, in needles per mm, to stiffness, in N per mm, between 0.5 and 0.7.

12. The article of furniture of claim 10, wherein the at least one multifilament has a ratio of machine gauge, in needles per inch, to linear density, in denier, between 0.01 and 0.03.

13. The article of furniture of claim 10, wherein the at least one multifilament is a high tenacity, fully drawn yarn.

14. The article of furniture of claim 10, wherein the at least one multifilament is air jet textured.

15. The article of furniture of claim 10, wherein the at least one monofilament has a tensile strength between 3 N and 10 N at 10% strain.

16. A suspension material for use with an article of furniture, the suspension material comprising:

at least one multifilament forming a jersey knit structure which has a plurality of courses extending in a course direction and a plurality of wales extending in a wale direction; and at least one monofilament corresponding to and being inlaid in a respective one of the courses, the at least one monofilament having a ratio of machine gauge, in needles per mm, to stiffness, in N per mm, between 0.5 and 2.6, and having a ratio of machine gauge, in needles per inch, to linear density, in denier, between 0.005 and 0.02;

wherein the suspension material has, in the course direction, a ratio of machine gauge, in needles per mm, to course stiffness, in N per mm, between 0.02 and 0.2 and has, in the wale direction, a ratio of machine gauge, in needles per mm, to wale stiffness, in N per mm, between 0.07 and 1.4.

17. The suspension material of claim 16, wherein the suspension material has an ultimate tensile strength in the course direction of at least 300 N, and wherein the suspension material has an ultimate tensile strength in the wale direction of at least 300 N.

18. The suspension material of claim 16, wherein the suspension material has a fabric weight between 315 $g/m^2$ and 945 $g/m^2$.

19. The suspension material of claim 16, wherein the suspension material has a course stiffness of at least 8 N per mm and a wale stiffness of at least 1.5 N per mm.

20. The suspension material of claim 16, wherein the suspension material has a ratio of machine gauge, in needles per mm, to inlaid monofilament count, in ends per mm, between 0.6 and 1.4.

* * * * *